US005183368A

United States Patent [19]

Douard

[11] Patent Number: 5,183,368

[45] Date of Patent: Feb. 2, 1993

[54] APPARATUS FOR TRANSPORTING LIGHT LOADS BY MEANS OF SELF-PROPELLED CARRIAGES ON RAILS

[75] Inventor: Pierre René Douard, Voisins le Bretonneux, France

[73] Assignee: Fluidelec, France

[21] Appl. No.: 704,487

[22] Filed: May 23, 1991

[51] Int. Cl.[5] ..... B65H 5/00

[52] U.S. Cl. ..... 414/222; 414/265; 414/337; 414/373; 198/465.1; 198/465.4; 198/687.1; 198/803.01

[58] Field of Search ..... 414/222, 225, 265, 337, 414/338, 373, 389, 401, 402, 498, 573, 584, 609; 410/77, 79, 84, 90, 91; 198/803.01, 465.1, 465.4, 687.1

[56] References Cited

U.S. PATENT DOCUMENTS

| | | | |
|---|---|---|---|
| 1,499,971 | 7/1924 | Callison | 414/337 |
| 1,801,574 | 4/1931 | Schuldt | 198/803.01 |
| 3,869,052 | 3/1975 | Leahy | 414/401 |
| 3,902,427 | 9/1975 | Kastenbein | 414/609 X |
| 3,910,196 | 10/1975 | Denenburg | 414/338 X |
| 4,015,537 | 4/1977 | Graef et al. | 104/91 |
| 4,077,590 | 3/1978 | Shorey | 410/77 |
| 4,538,950 | 9/1985 | Shiomi et al. | 414/222 |
| 4,805,859 | 2/1989 | Hudson | 410/77 X |

FOREIGN PATENT DOCUMENTS

| | | | |
|---|---|---|---|
| 3308778 | 9/1984 | Fed. Rep. of Germany . | |
| 1175757 | 8/1985 | U.S.S.R. | 414/498 |
| 2194498 | 3/1988 | United Kingdom . | |

*Primary Examiner*—David A. Bucci
*Assistant Examiner*—Donald W. Underwood
*Attorney, Agent, or Firm*—William A. Drucker

[57] ABSTRACT

An apparatus is disclosed for transporting loads of the type comprising self-propelled carriages movable on rails and having assembly structure on which removable containers may be engaged and temporarily fixed, loading and unloading of such containers taking place in automatic loading and/or unloading stations.

The assembly structure contains at least one assembly profile oriented parallel to the axis of movement of the carriage and cooperating with a corresponding assembly profile provided on the containers, so that the assembly or disassembly of the containers may take place after a relative carriage/container translational movement parallel to said axis of movement.

13 Claims, 3 Drawing Sheets

APPARATUS FOR TRANSPORTING LIGHT LOADS BY MEANS OF SELF-PROPELLED CARRIAGES ON RAILS

BACKGROUND OF THE INVENTION

1. Field of the Invention

The invention relates to apparatus for transporting light loads (10 to 15 kg) placed in containers conveyed by self-propelled carriages on rails.

2. Description of the Prior Art

Generally, different apparatus of this kind have already been proposed.

Thus, in a first type of apparatus, known particularly from the patent U.S. Pat. No. 4,015,537, the containers are fixed permanently to the self-propelled carriages.

In this case, the carriages may be equipped with mobile sliders memorizing the receiving station. So that such installations operate correctly, the stations must have permanently available a number of carriages which are pre-assigned to them. For this, the receiving stations must return them imperatively to the sending station in the shortest possible time. This is a major drawback resulting in the jamming of the installations if the rules for working are not complied with.

Of course, with the transport apparatus driven by computer, the self-propelled carriages may be provided for two-way working. In this case, the stations no longer have pre-assigned carriages. They are parked in parking zones provided for this purpose at different positions in the installation. A station wishing to make a dispatch calls a self-propelled carriage with empty container and, after loading, dispatches it. The receiving station must unload the carriage in the shortest possible time and send it back to a zone for parking carriages with empty containers.

Thus, in the two above types of apparatus, the receiving stations, since they do not dispatch carriages, are very quickly saturated. This situation reduces the performances and results rapidly in jamming of the installation.

Another type of apparatus divulged particularly by the German patent DE 33 08778 provides removable containers which can be locked on the self-propelled carriages. However, the drawback of this solution resides in the fact that in order for the installation to be able to operate correctly, the user must be present at the time when the self-propelled carriage penetrates into the station, either for loading it or for unloading it, so that it may be used rapidly again for another mission. To overcome this drawback. The patent GB 2 194 498 provides an automatic loading/unloading station in which the containers are engaged on the carriages transversely to their axis of movement. However, such an installation requires relatively complex and expensive loading/unloading stations.

SUMMARY OF THE INVENTION

The purpose of the invention is in particular to overcome these drawbacks.

It provides a transport apparatus of said type comprising self-propelled carriages movable on rails and having assembly means on which removable containers may be engaged and temporarily fixed, loading and unloading of such containers on to the carriages taking place in automatic loading and/or unloading stations.

According to the invention, this apparatus is characterized in that the assembly means comprise at least one assembly profile oriented parallel to the axis of movement of the carriage and cooperating with a corresponding assembly profile provided on the containers, so that the assembly or disassembly may take place after a relative carriage/container translational movement parallel to said axis of movement.

Advantageously, the drive force required for the translational movement is exerted by the carriage itself.

In this case, the loading stations will have to comprise means for placing the containers in the assembly position, i.e. a position in which a carriage may itself be engaged by its assembly profile on the assembly profile of the container.

The unloading stations will have to comprise, in an unloading zone, extraction means acting on the containers, so as to hold them motionless during the disassembly phase, i.e. while the carriage carries out the translational movement producing such disassembly.

Of course these loading and/or unloading stations may comprise a distributor either for bringing the containers into the loading zone or for removing the containers from the unloading zone.

BRIEF DESCRIPTION OF THE DRAWINGS

Embodiments of the invention will be described hereafter, by way of non limitative examples, with reference to the accompanying drawings in which.

DESCRIPTION OF THE PREFERRED EMBODIMENTS

Figure 1:
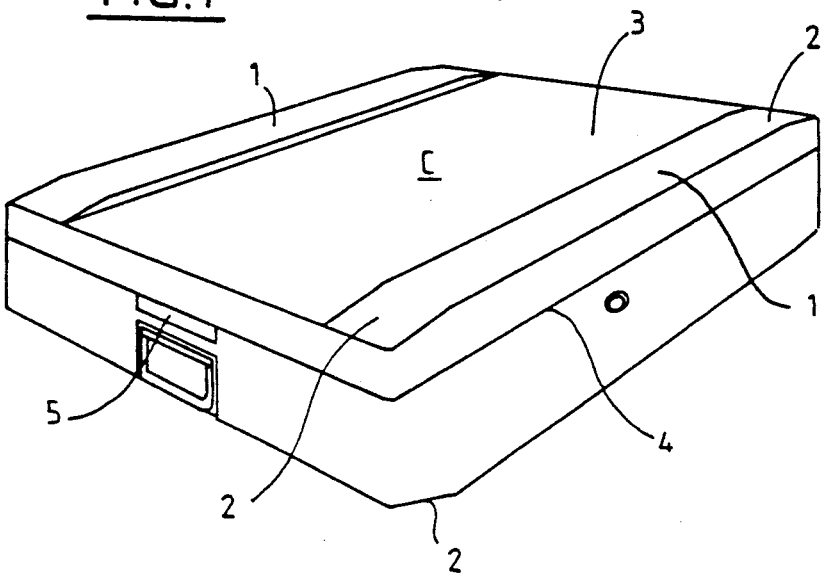
FIG. 1 is a schematic perspective view of a container according to the invention.

In FIG. 1, container C shown in perspective comprises longitudinal bosses 1 on each of its lateral sides. These bosses 1 are situated symmetrically at the top and bottom part of container C. Bosses 1 have at each end inclined planes 2 facilitating insertion thereof in the slides 12 of the carriage shown in FIG. 2.

Cover 3 of container C opens on the largest face and its joint plane is referenced at 4. The cover 3 of the container is equipped with a closure means 5 on one of the smallest faces and a hinge on the other face.

In a variant, not shown, the closure means 5 forms a hinge at the same time. In this case, the small opposite faces of the container are equipped with the hinge closure 5. It is then possible to open the cover 3 on any of its small faces, even to remove the cover by simultaneously operating the hinge closures 5 located on the opposite faces.

Figure 2:
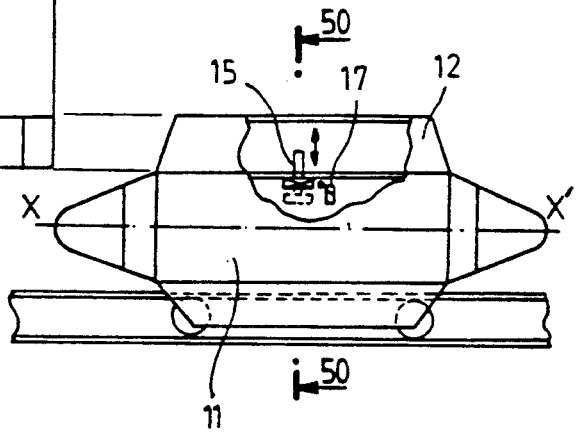
FIG. 2 is a side view of a carriage with its devices for loading, unloading and locking the container; bosses and the locking cavity.

Referring to FIG. 2, the self-propelled carriage 11 is equipped with a slide module 12 oriented parallel to the axis of movement XX'. The slide assembly 12 has at its center an electrically controlled locking device 15 which comprises a retractable stud which can be engaged in a cavity 6 provided in the container. An electric or electronic control 17 checks the correct position of the locking device 15.

Figure 3:
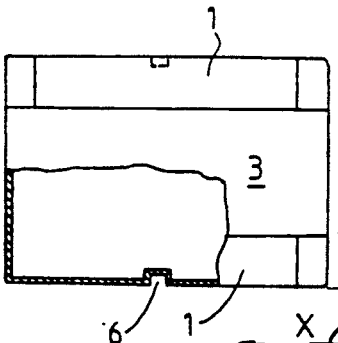

It can be seen in FIG. 3 that when it moves in the direction of the arrow, slide 12 of carriage 11 is engaged on the bosses 1 of container C. The locking device 15 locks the carriage 11 to the container when the retractable stud is housed in the cavity 6 of the container.

Figure 4:
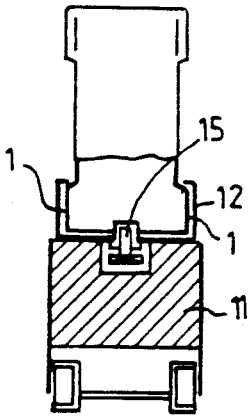
FIG. 4 is a cross section through 50—50 of the carriage carrying a container in accordance with the invention.

The sectional view through 50—50 (FIG. 4) of the carriage 11 of FIG. 2 shows the way in which the locking device 15 locks together container C and its bosses 3 by means of slide 12.

In the example shown in FIGS. 1 to 4, the slide assembly 12 has a substantially U shaped cross section with the upper ends of the two vertical legs of the U bent inwards.

Of course, the invention is not limited to such an arrangement.

Figures 6A, 6B, 6C:
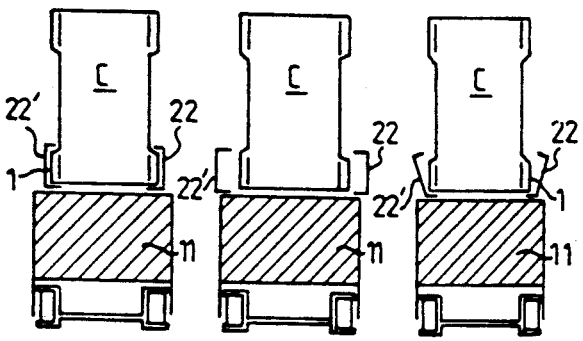
FIGS. 6A, 6B and 6C are cross sections through 51—51 of FIG. 5 for illustrating two variants of the device for gripping the container.
Figure 5:
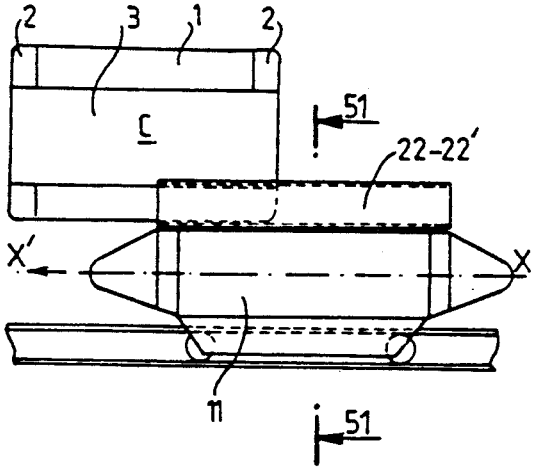
FIG. 5 is a side view illustrating the loading of a container on a carriage, in a variant of the invention.

Thus, the slide assembly could have, instead of a fixed structure, two parallel elements shaped in the form of a C, 22 and 22', with mutually facing concavity, these two elements 22, 22' (which correspond to the above mentioned vertical legs) being movable with respect to each other under the action of an actuating mechanism not shown, so as to pass from an open position facilitating insertion or removal of container C to a closed position in which they intimately mate with the bosses 1 of container C (position shown in FIG. 6C).

The channel elements 22, 22' may move in translation, as shown in FIG. 6B, or rock as shown in FIG. 6A.

The form of the channel elements may be designed so as to provide, in addition to gripping the container C, efficient locking of this container C on the self-propelled carriage 11, particularly during the travel between two stations.

Figure 7:
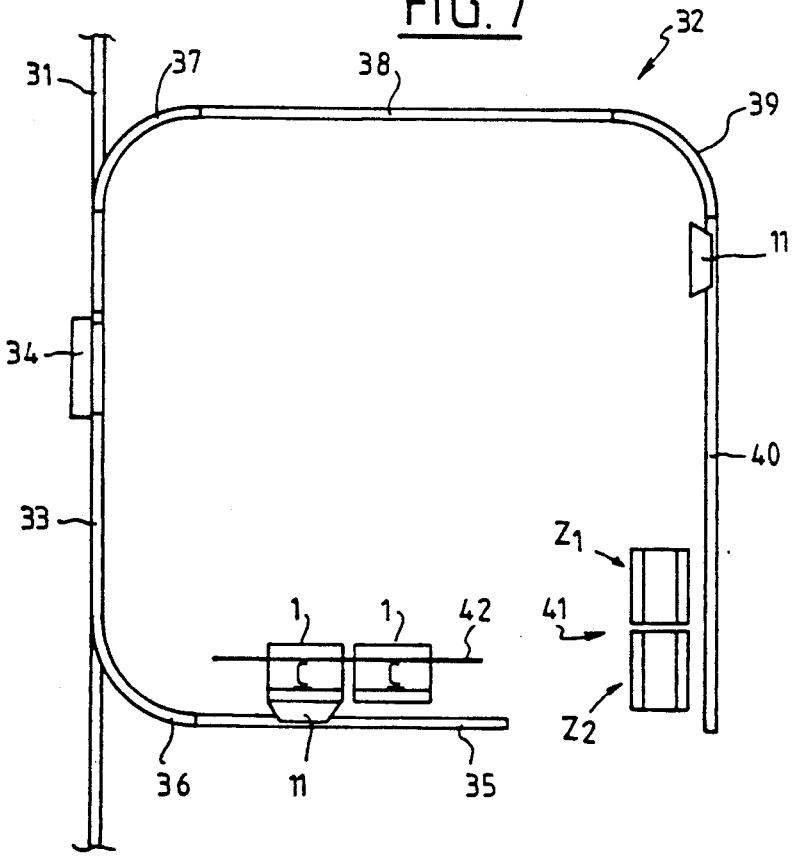
FIG. 7 shows a station with its loading and unloading zones.

FIG. 7 shows the structure of a loading/unloading station which equips a main track 31. This station comprises a loading/unloading track 32 which follows a square or rectangular path, open at the level of an angular region of the square or rectangle thus formed.

This loading/unloading track comprises more particularly:

- a first rectilinear length 33 which extends parallel to the main track 31 and which is associated therewith by a translational switch 34 designed for transferring the self-propelled carriage 11, with or without its container 4, from the main track 31 to the rectilinear length 33 or, conversely, from this rectilinear length 33 to the main track 31,
- an unloading section comprising a second rectilinear track length 35 connected to one end of length 33 via a portion 36 curved at 90°,
- a loading section comprising successively:
- a third rectilinear track length 38 connected to the second end of the first length 33 via a second curved portion 37,
- a fourth rectilinear track length 40 connected to the third length by a third curved portion 39, this third length 40 extending parallel to the first length 33 and being equipped at its end with an automatic loading device.

Above length 35 of the unloading section there is disposed a conveyor 42 adapted to mesh with the upper bosses 1 of the container C brought by the self-propelled carriages 11 into the unloading area.

Once the carriage 11 and container C have been disassembled by a rearward movement of carriage 11, container C remains suspended on conveyor 42. The latter may then have a slope so that container C can move under the effect of its own weight, as far as a storage area.

The loading area 41 associated with length 40 of the loading section comprises two successive loading zones $Z_l$, $Z_2$ on which container C may be centered so as to be automatically assembled on carriage 11 and be locked in the way described above.

It can be seen that not only the loading station but also the unloading station may be formed without using complex distributors.

The invention does not however exclude the use of distributors.

Figure 8:
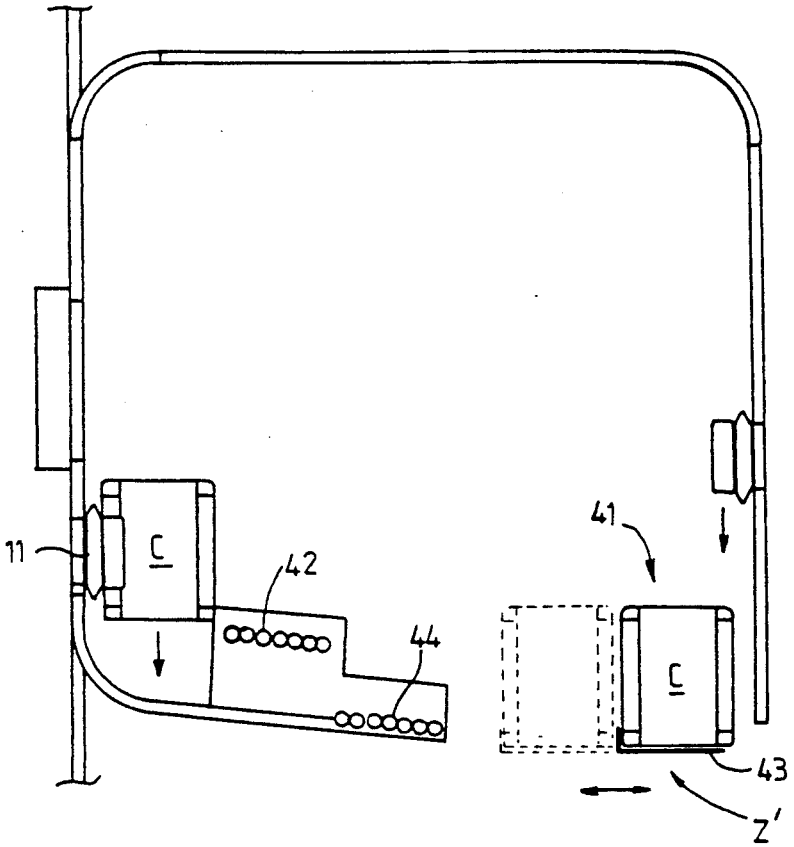
FIG. 8 shows a variant of a station similar to that of FIG. 7.

Thus, in the example shown in FIG. 8, the loading station 43 comprises a distributor formed by a simple drawer 43 for bringing and positioning the container in the loading area Z'. This drawer 43 is movable between two positions, namely:

- a waiting position shown with dotted lines in figure 8 (position in which it may receive a container),
- a transitory position for placing the container C in the loading area Z' (position shown with continuous lines).

In this example, the unloading station comprises, after conveyor 42 described in connection with FIG. 7, a second inclined conveyor 44 on which the lower part of container C comes to bear.

The invention is not limited to a given shape of the assembly profile.

Figure 9:
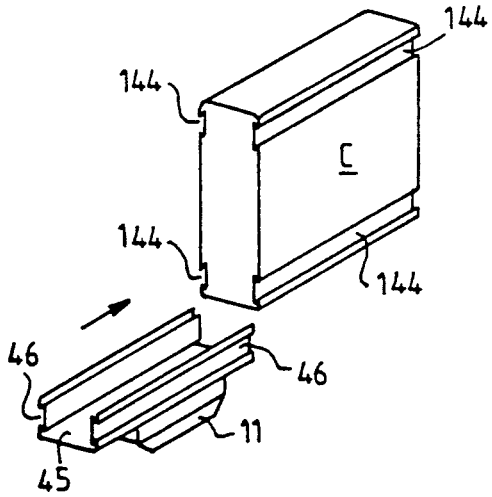
FIG. 9 is a perspective view of a self-propelled carriage and its container having an assembly profile of dovetail type.

Thus, instead of bosses, container C could comprise prismatic concavities 144, for example of a dovetail cross section, as shown in FIG. 9. In this case, the slides may be formed by means of a length of channel iron 45 with a substantially U cross section whose base is fixed to carriage 11 and whose vertical flanges have ribs 46 of a shape substantially complementary to that of the prismatic concavities 144.

Figure 10:
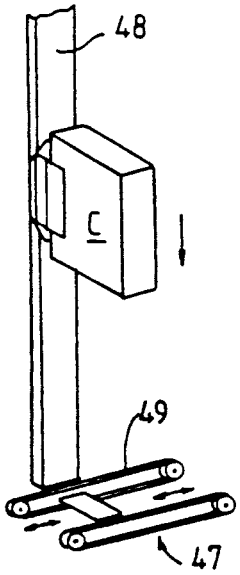
FIGS. 10 and 11 are schematic perspective views of a station which may serve for loading and unloading, FIG. 10 showing the phase preceding unloading and figure 11 the end of the unloading phase.
Figure 11:
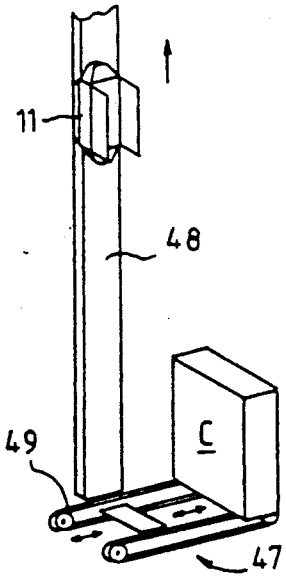

FIGS. 10 and 11 illustrate a particularly advantageous embodiment of a loading and/or unloading station.

In this example, the loading/unloading area 47 is located in a horizontal plane perpendicular to track 48. It consists of the platform formed by a belt conveyor 49 which extends on each side of track 48.

During an unloading phase, the carriage 11/container C assembly is brought into the unloading station 47 until the front face of container C comes to bear on the unloading area. Carriage 11 is immobilized in this position, unlocks container C then moves rearwards to detach itself from container C. The belt transporter 49 is then actuated so as to bring container C into a storage zone located at the left or right of the track.

With such an arrangement, a container may be loaded by a procedure strictly the reverse of that for unloading it.

It is then clear that the invention, using particularly simple and inexpensive means, overcomes the problems mentioned above which, up till now, curbed the development of this type of load transporting apparatus.

What is claimed is:

1. Apparatus for transporting light loads in the range of 10 to 15 kg comprising:

at least one self-propelled carriage having a longitudinal axis and movable on rails along said axis, said rails having horizontal and vertical portions, said carriage being provided with a first assembly profile oriented parallel to said axis and with first locking means;

at least one removable container having a hollow body and a cover which is hinged on a lateral face of said body about a pivoting axis, said container having a second assembly profile formed both on said body and on said cover and oriented at right angles with said pivoting axis, and shaped so as to be slidingly assembled with said first assembly profile once placed in an assembly position by effecting a relative translational displacement of said carriage with respect to said container along said longitudinal axis on a loading portion of said rail, said removable container further having first and second bearing surfaces respectively formed on said body and on said cover and oriented at right angles with said pivoting axis, and second locking means which cooperate with said first locking means so as to provide a rigid attachment between said carriage and said container once assembled;

at least one loading station comprising means for placing and retaining said container in front of said loading portion in said assembly position;

at least one unloading station comprising an unloading portion of rail, holding means for retaining said container while being transported by said carriage on said unloading portion, two parallel conveyors disposed in front of said unloading portion and under said bearing surfaces when said carriage provided with said container is in said unloading portion so as to allow disassembling of said container from said carriage according to an unloading sequence comprising an unlocking step of said locking means, a translational displacement of said carriage while said container is retained by said holding means and a conveying step of said container of said conveyor once said container is disengaged from said carriage.

2. The apparatus as claimed in claim 1, wherein one of said assembly profiles is convex, whereas the other assembly profile is concave and said locking means comprises a retractable stud integral with said carriage which can be engaged in a cavity provided in the container when said assembly profiles are engaged in each other.

3. The apparatus as claimed in claim 1, wherein the assembly profile of a container comprises two longitudinal bosses respectively formed on said body and on said cover adjacent to a bottom face of said container and the assembly profile of the carriage is formed by a longitudinal slide having a U shaped cross section having two vertical legs bent inwardly.

4. The apparatus as claimed in claim 1, wherein the assembly profile of the container has a prismatic concave shape, whereas the assembly profile of the carriage is convex.

5. The apparatus as claimed in claim 4, wherein the assembly profile of the container has a concave dovetail shape and the assembly profile of the carriage is formed by means of a U shape channel element of a form complementary to that of the concave dovetail shape.

6. The apparatus as claimed in claim 1, wherein the assembly profile of the carriage is formed by two parallel channel elements which are movable with respect to each other under the action of an actuating mechanism, said profile providing said locking means.

7. The apparatus as claimed in claim 6, wherein the channel elements are movable in translation.

8. The apparatus as claimed in claim 1, wherein the loading stations comprise a distributor formed by a simple drawer for bringing and positioning a container in a loading area in which said container can be assembled with a self-propelled carriage, this drawer being movable between two positions:

a waiting position in which it may receive a container, and a transitory position for placing the container in the loading area.

9. The apparatus as claimed in claim 6, wherein the channel elements are movable by rocking.

10. The apparatus as claimed in claim 3 wherein the bearing surfaces of said container comprises two longitudinal bosses respectively formed on said body and on said cover adjacent to a top face opposite to said bottom face of said container.

11. The apparatus as claimed in claim 1 wherein said loading station comprises a vertical portion of rail ended by a lower portion including said loading portion, a conveyor extending horizontally under said lower portion and which is located so s to bring said container on said conveyor in said assembly position.

12. Apparatus for transporting loads comprising:

at least one self-propelled carriage having a longitudinal axis and movable on rails along said axis, said carriage being provided with a first assembly profile oriented parallel to said axis and with first locking means;

at least one removable container having a second assembly profile shaped so as to be slidingly assembled with said first assembly profile once placed in an assembly position by effecting a relative translational displacement of said carriage with respect to said container along said longitudinal axis on a loading portion of said rail, said removable container further having second locking means which cooperate with said first locking means so as to provide a rigid attachment between said carriage and said container once assembled;

at least one loading station comprising means for placing and retaining said container in front of said loading portion and in said assembly position;

at least one unloading station comprising a vertical portion of rail ended by a lower portion, a conveyor extending horizontally under said lower portion, and means for effecting an unloading sequence comprising a downwards displacement of said carriage on said vertical portion while the container is retained by its own weight on the conveyor.

13. Apparatus for transporting loads comprising:

at least one self-propelled carriage having a longitudinal axis and movable on rails along said axis, said carriage being provided with a first assembly profile oriented parallel to said axis and with first locking means;

at least one removable container having a second assembly profile shaped so as to be slidingly assembled with said first assembly profile once placed in an assembly position by effecting a relative translational displacement of said carriage with respect to said container along said longitudinal axis on a loading portion of said rail, said removable container further having second locking means which cooperate with said first locking means so as to provide a rigid attachment between said carriage and said container once assembled;

at least one loading and unloading station comprising a vertical portion of rail ended by a lower portion including said loading portion, a conveyor extending horizontally under said lower portion, means for effecting an unloading sequence comprising downwards displacement of said carriage on said vertical portion until the container comes to bear on said conveyor, an unlocking step of said locking means and an upwards displacement of said carriage on said vertical portion while the container is retained by gravity on the conveyor, and, means for effecting a loading sequence comprising a conveying step to bring said container on said conveyor in said assembly position, a displacement of the carriage down to said loading portion while the container is bearing on said conveyor and a locking step of said locking means.

* * * * *